US006676210B1

(12) United States Patent
Peyton

(10) Patent No.: US 6,676,210 B1
(45) Date of Patent: Jan. 13, 2004

(54) WASHABLE HIGHCHAIR SLIPCOVER

(76) Inventor: Kami Peyton, 8375 Kenningston Way, Duluth, GA (US) 30097

( * ) Notice: Subject to any disclaimer, the term of this patent is extended or adjusted under 35 U.S.C. 154(b) by 0 days.

(21) Appl. No.: 10/373,853

(22) Filed: Feb. 27, 2003

(51) Int. Cl.[7] ..... A47C 31/00
(52) U.S. Cl. ..... 297/219.12; 297/228.13; 297/DIG. 6
(58) Field of Search ..... 297/219.12, 228.13, 297/256.17, 467, DIG. 6

(56) References Cited

U.S. PATENT DOCUMENTS

| | | | | |
|---|---|---|---|---|
| 1,376,625 | A | * | 5/1921 | Johnston |
| 2,652,183 | A | * | 9/1953 | Hivka |
| 3,713,692 | A | * | 1/1973 | McCracken et al. |
| 4,568,125 | A | * | 2/1986 | Sckolnik |
| 4,805,937 | A | * | 2/1989 | Boucher et al. |
| 4,861,109 | A | * | 8/1989 | Leach |
| 4,881,746 | A | | 11/1989 | Andreesen |
| 5,042,878 | A | * | 8/1991 | Collins |
| 5,238,293 | A | | 8/1993 | Gibson |
| 5,330,250 | A | | 7/1994 | Reyes |
| D383,636 | S | | 9/1997 | Harris |
| 5,678,888 | A | | 10/1997 | Sowell et al. |
| 5,702,039 | A | | 12/1997 | Olaiz |
| 5,715,571 | A | | 2/1998 | Fasano |
| 6,129,417 | A | | 10/2000 | Cohen-Fyffe |
| 6,142,565 | A | | 11/2000 | Rieder |
| 6,224,152 | B1 | | 5/2001 | Hughes |
| 6,428,098 | B1 | | 8/2002 | Allbaugh |
| D465,959 | S | | 11/2002 | Cameron |

* cited by examiner

*Primary Examiner*—Milton Nelson, Jr.
(74) *Attorney, Agent, or Firm*—Richard C. Litman

(57) ABSTRACT

The washable highchair slipcover is a one-piece, flexible cover made from washable material and designed to cover the seating area and supports of a highchair, particularly highchairs used by the general public in restaurants. The cover has a generally square-shaped central base that serves as the seat portion and is cushioned to provide additional comfort for the occupant. Foldable front, rear, and side panels extend from the central base. The front panel is T-shaped having a crotch section and front flap. A plastic placemat for covering a highchair tray is connected to the front flap by snap fasteners. One or more straps connect to the front panel by snap fasteners and have mating patches of hook and loop fastening material for looping around and securing toys to the slipcover. A storage pocket is formed on the rear panel.

15 Claims, 8 Drawing Sheets

WASHABLE HIGHCHAIR SLIPCOVER

BACKGROUND OF THE INVENTION

1. Field of the Invention

The present invention relates generally to seat covers. More specifically, the invention is a one-piece, washable, pliable slipcover designed to cover infant highchairs, particularly restaurant highchairs used by the general public, thereby preventing the skin of an infant occupying the highchair from coming in direct contact with the highchair and table surface, which reduces exposure to germs and unsanitary conditions.

2. Description of the Related Art

Families with infants often have occasion to eat away from home, either fine dining at a quality restaurant, or a quick meal at a fast food facility. In either case, it is often necessary to place the infant in a highchair, safety seat, or booster seat provided by the restaurant or food service facility. Although restaurants and other food service facilities take some measures to clean the highchair before and after use for sanitary purposes, often this amounts to no more than a quick wipe down with a damp towel. While the highchair may appear sanitary upon casual visual inspection, nevertheless, many parents remain concerned that their infant, and particularly an infant less than six or nine months of age, may pick up an infection from germs or dirt left behind on the highchair seat, or the removable table or tray which attaches to the arms of the highchair. Various furniture covers for covering articles of furniture have long been known, and various inventions have been directed towards improving the sanitation of highchairs used in public food facilities, but none disclose the washable highchair slipcover of the present invention.

U.S. Pat. No. 6,428,098, issued Aug. 6, 2002 to F. Allbaugh, discloses a one-piece, flexible liner for a highchair. The liner is reusable, removable, foldable, and capable of adapting to other types of children seats, such as baby strollers and baby carriers. A generally square-shaped seat portion serves as the base from which portions extend from all four sides to form the front, rear, and sides of the invention. The liner has a bulky appearance and offers no protection for the infant from direct contact with the abutting table surface.

U.S. Pat. No. 6,142,565, issued Nov. 7, 2000 to S. Rieder, describes an infant chair liner designed to be used in conjunction with several types of infant seats: highchairs, strollers, car seats, etc. The liner is comprised of a one-piece armrest and backrest component that has a fabric cover which can be washed. However, the user must unzip and remove the fabric cover to wash it and then place it back on the liner.

U.S. Des. Pat. No. 383,636, issued Sep. 16, 1997 to M Harris, shows a highchair cushion that has a generally square-shaped seat portion from which three bifurcated portions extend from both sides and the rear to the form the invention. There is corresponding hook and loop attaching means located on the underside of each bifurcated portion that secures the folded flap to the remainder of the bifurcated portion. The highchair cushion has no front portion, thus it offers no barrier between the infant and the crotch strap or horizontal lap bar of highchairs equipped with such. U.S. Des. Pat. No. 465,959, issued Nov. 26, 2002 to E. Cameron, shows a similar design in a highchair protective cover that features the addition of an extending front portion that folds over the horizontal lap bar. However, no barrier exists between the infant and the table surface to protect the infant from direct contact with the table surface. In addition, neither design shows a means for attaching infant-related items, such as small toys, to the body of the highchair covering mechanism.

U.S. Pat. No. 4,881,746, issued Nov. 21, 1989 to S. Andreesen, discloses a handle cover and toy holder for a shopping cart. The invention comprises a washable strip of fabric that covers a shopping cart handle and is secured to the handle by corresponding strips of hook and loop fasteners located on opposing ends. There is a strap suspended from the midpoint of the secured handle cover that has a means for holding a toy and maintaining the handle cover in a folded state. U.S. Pat. No. 5,715,571, issued Feb. 10, 1998 to S. Fasano, teaches a similar shopping cart handle cover that wraps around a shopping cart handle and is secured by a hook and loop fastener system. This shopping cart handle cover has a plurality of straps suspended from said cover that are a means of holding toys and an infant bottle. In addition, U.S. Pat. No. 5,702,039, issued Dec. 30, 1997 to J. Olaiz, discloses a utility belt used in conjunction with a child stroller that features a plurality of straps suspended from the main belt that use hook-and-loop fasteners to hold toys and even an infant bottle. None of these toy-holding means can be readily used in conjunction with al protective cover designed primarily for use with restaurant highchairs.

Many patents in the prior art are related to seat covers for shopping carts. The seat portion of a conventional shopping cart has a generally rectangular basket configuration. In contrast, the seat portion of a highchair generally has more of a square basket configuration. Thus, seat covers designed particularly for shopping carts that purport to be suitable for highchairs result in an awkward fit when placed in a highchair due to excess material dangling over the edges of the highchair.

U.S. Pat. No. 5,238,293, issued Aug. 24, 1993 to D. Gibson, discloses a shopping cart seat cover that has a system for holding an infant's toys or bottles. U.S. Pat. No. 5,330,250, issued Jul. 19, 1994 to G. Reyes, and U.S. Pat. No. 6,224,152 B1, issued May 1, 2001 to Hughes et al., describe liners for a shopping cart child seat that feature a padded backrest and seat cushion, respectively, and seatbelt restraining systems, but the shopping cart handle and leg area remain uncovered, thereby posing a risk that the infant may come in direct contact with germs resulting from public use.

U.S. Pat. No. 6,129,417, issued Oct. 10, 2000 to M. Cohen-Fyffe, discloses a shopping cart seat cover where the front and rear sides of the cover, which extend from the central seat portion, are designed with sleeves that fit over the top of the handle and rear wall, respectively, of the shopping carts seating area to secure the cover to the shopping cart. Furthermore, piping is used in the seams to maintain the shape of the seat cover. Thus, this seat cover cannot be readily adapted to most highchairs. U.S. Pat. No. 5,678,888, issued Oct. 21, 1997 to Sowell et al., teaches a similar configuration for a shopping cart seat cover that suffers essentially from the same shortcoming.

None of the above inventions and patents, taken either singly or in combination, is seen to describe the instant invention as claimed. Thus a washable highchair slipcover solving the aforementioned problems is desired.

SUMMARY OF THE INVENTION

The washable highchair slipcover is a one-piece, pliable cover designed to cover the seating area and supports of a highchair, particularly highchairs used by the general public in restaurants. The cover has a generally square-shaped central base that serves as the seat portion and is cushioned to provide additional comfort for the occupant. A generally T-shaped front portion extends from the middle of the front side of the base and allows the infant's legs to pass while shielding the infant from the crotch strap and lap bar of the highchair once the infant is placed on the cover. Opposing side portions extend upwardly from each side of the base and serve to encompass the side supports. The rear portion extends upwardly from the rear side of base and has apertures in each opposing corner at the foot of the rear portion to accommodate the use of safety belts integral to the highchair. A detachably connectable, reusable placemat made from a durable, flexible, thin plastic sheet is also provided to cover the table surface used by the child and provide a clean feeding area for the child, thereby preventing the child from placing his or her mouth on the table, such as when teething. Straps with hook and loop fasteners are provided for attaching toys or other items to the surface of the front portion facing the child. When not in use, the toy-attaching mechanisms are stored in a rectangular storage pocket that is affixed to the back flap of the rear portion. For ease of transport and storing, the slipcover folds into a compact form.

The placemat is a generally D-shaped plastic placemat that can be detachably coupled to the front portion of the cover. The placemat has a plurality of male connectors located under the front edge of the placemat that mate with female connectors on the front portion in a button snap arrangement. The generally D-shaped placemat rests on the table surface and extends sufficiently wide and far enough to impede the typical infant from coming in direct contact with any portion of the table surface.

The toy holders can be removably coupled to the inside upper area of the front portion above the crotch section. The toy holders are coupled to the front portion using a button snap arrangement and have a hook and loop fastening system on their inner sides where the bottom end is passed through a ring connected to the toy, then folded back towards the top and pressed to secure the toy in a suspended state. As the toy olders are detachable, there is a storage component to store them when not in use. The storage component is a rectangular panel made of like fabric and is located on the outer surface of the back flap of the rear portion.

The present invention can be folded neatly into a compact configuration and secured by a button snap arrangement.

Accordingly, it is a principal object of the invention to provide a highchair slipcover for covering the seating area of a highchair that is adaptable to most highchairs used in public settings and provides an instant barrier between the infant and the highchair and table surface.

It is an object of the invention to provide a highchair slipcover that reduces the exposure of an infant to germs and unsanitary conditions associated with the use of highchairs used by the general public.

It is another object of the invention to highchair slipcover that is lightweight, pliable, and easy to install in most highchairs, particularly those used in public settings.

It is another object of the invention to provide a highchair slipcover that is reusable and washable.

Still another object of the invention is to provide a highchair slipcover that has a means for holding items that foster the amusement of the infant-occupant.

It is an object of the invention to provide improved elements and arrangements thereof in an apparatus for the purposes described which is inexpensive to manufacture and purchase, dependable, and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
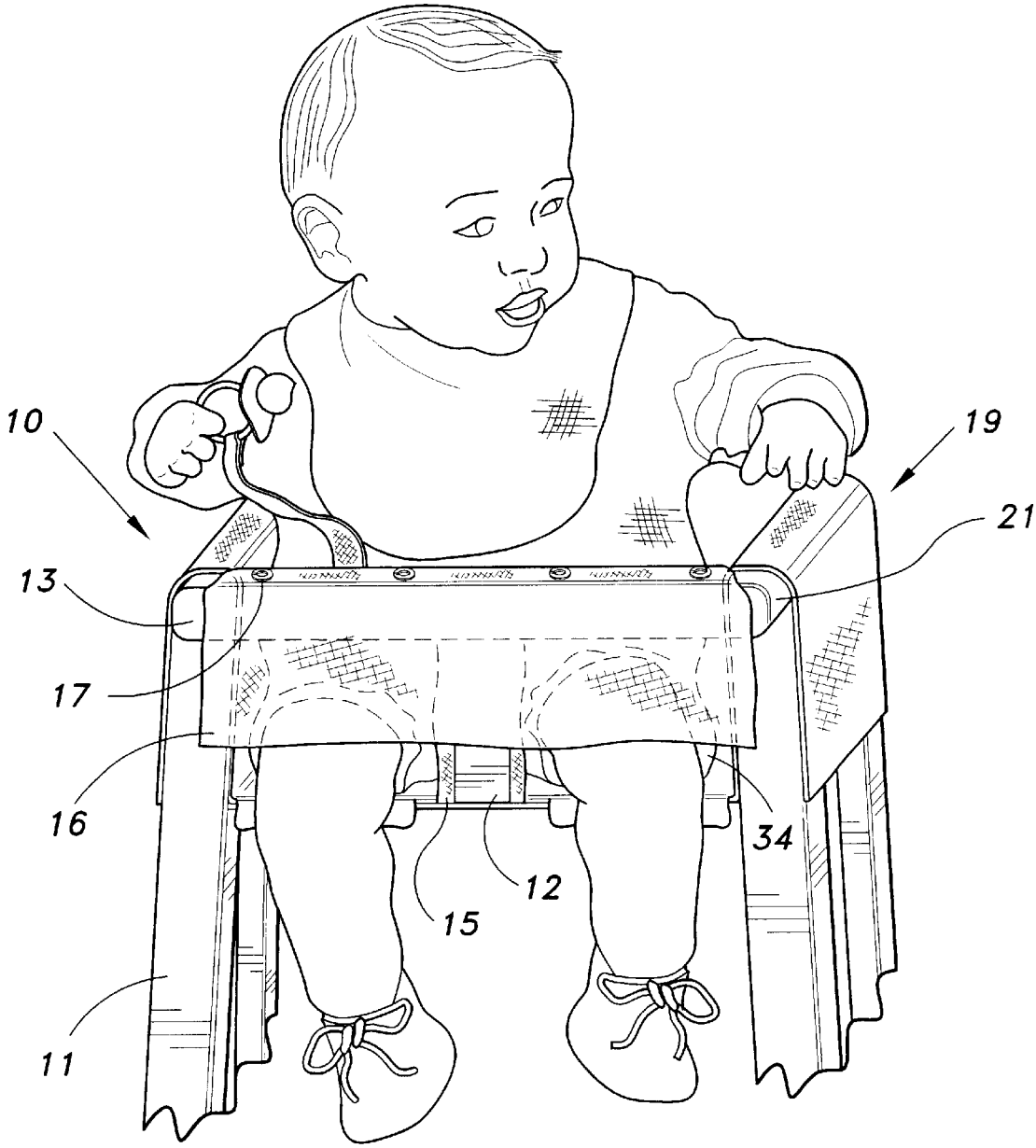
FIG. 1 is an environmental, perspective view of the washable highchair slipcover according to the present invention.

The present invention is a washable highchair slipcover, designated generally as 10 in the drawings. Referring to FIG. 1, the slipcover 10 for a highchair 11 or similar type of child seat is shown in use in a highchair 11, with an infant occupying the seat. The slipcover 10 of the present invention is particularly designed for use with highchairs typically used by the general public when dining in restaurants, but may also be suited for use in similar types of child seat.

Figure 2:
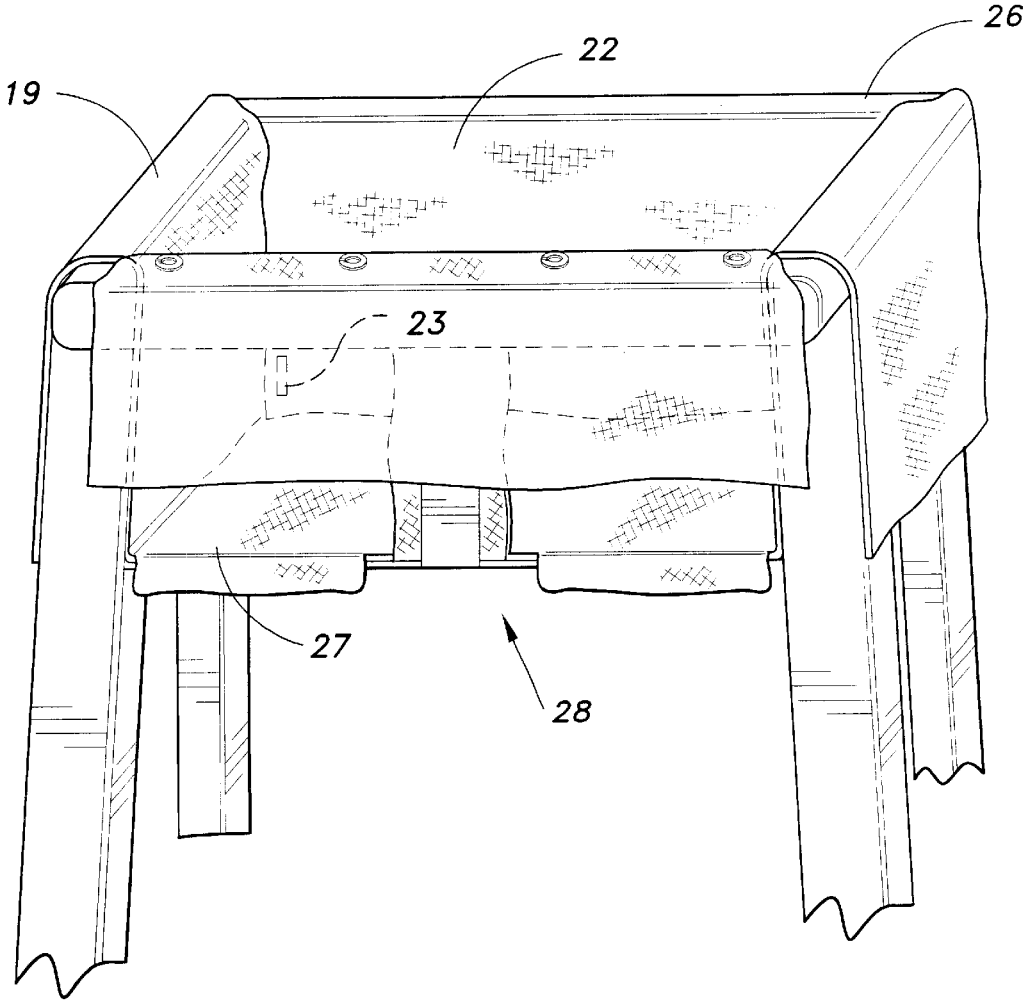
FIG. 2 is a front, environmental, perspective view of the washable highchair slipcover according to the present invention.

Referring to FIGS. 1 and 2, after the slipcover 10 is placed in the highchair 11, covering the seat 28 of the: highchair 11, the infant is placed in the highchair 11. The infant's legs are received through the corresponding apertures in the generally T-shaped front portion of the slipcover 10. When the slipcover 10 is in use, the crotch section 15 extends upward from the central seat portion 27 of the slipcover 10 and serves as a barrier between the infant's crotch area and the conventional highchair crotch strap 12, which is usually positioned between the infant's legs. The remainder of the front portion includes front flap 16, which is placed over the horizontal lap bar 13 of the highchair 11, and hangs in a suspended state therefrom. The front flap 16 prevents the infant occupying the seat from coming in direct contact with the horizontal lap bar 13, effectively reducing exposure to germs and other unsanitary conditions. In addition, the front flap 16 serves as the mating point for the toy holder attachments and the placemat, described below.

Figure 3:
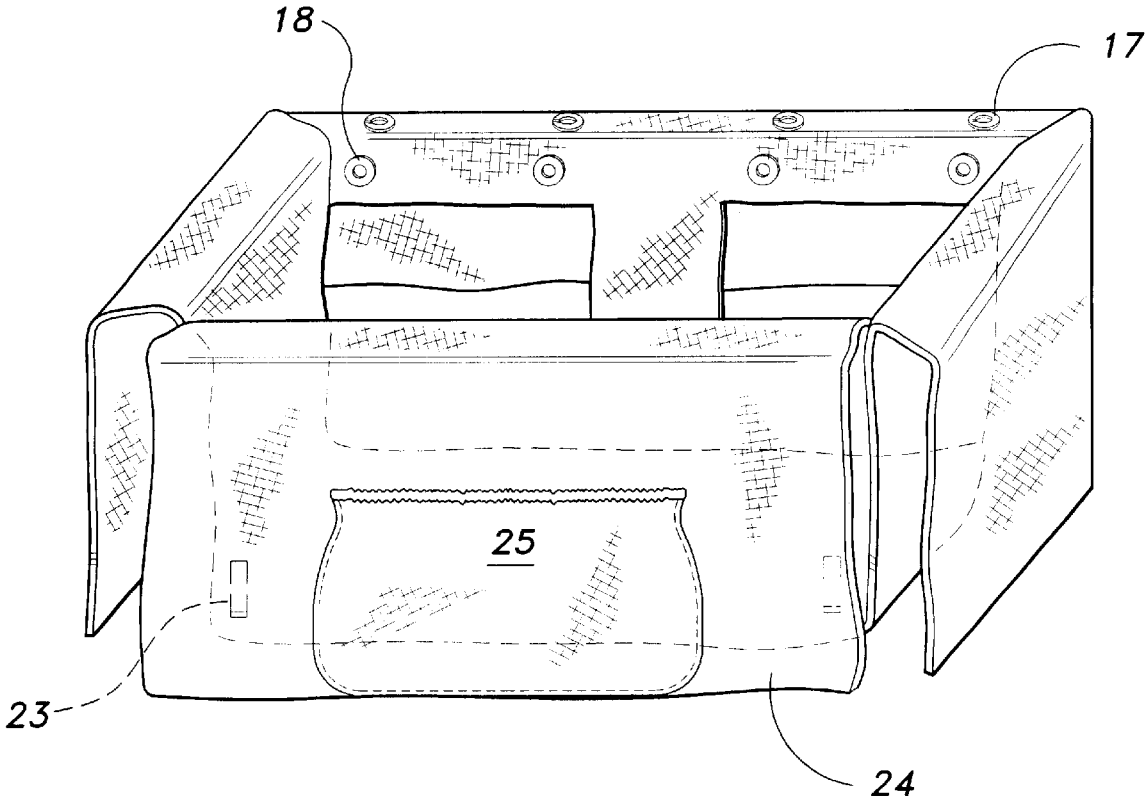
FIG. 3 is a rear perspective view of the washable highchair slipcover according to the present invention.
Figure 4:
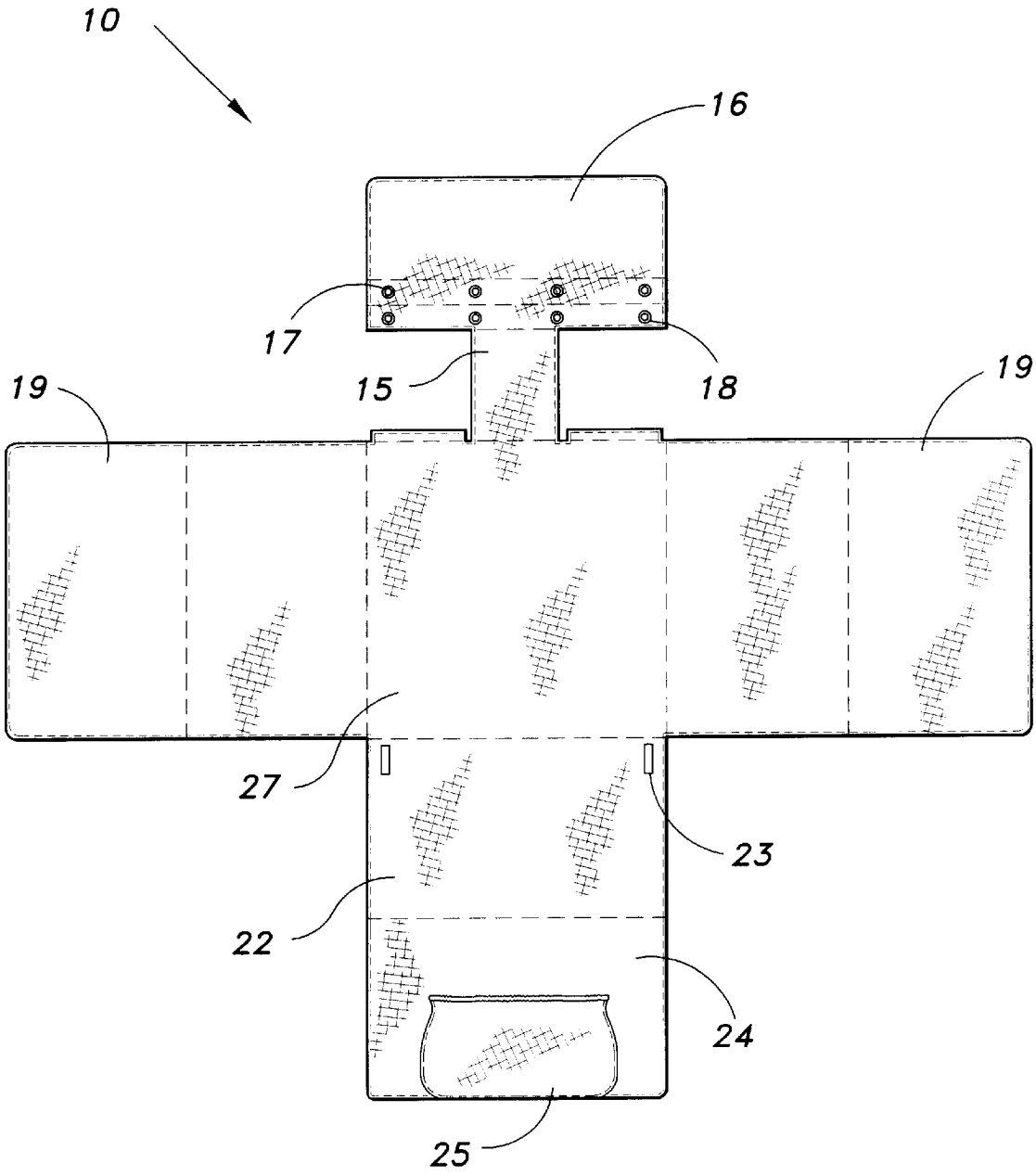
FIG. 4 is a plan view of the upper surface of an unfolded washable highchair slipcover according to the present invention.

Referring to FIGS. 1–4, slipcover 10 has a generally cross-shaped or cruciform shape when unfolded on a planar surface, seen most clearly in FIG. 4. The slipcover 10 comprises a central seat panel 27, a front panel portion comprising crotch portion 15 and front flap 16, a rear panel portion 22, a storage pocket 25 affixed to the back flap 24 of the rear portion 22, and opposing side panel portions 19. The slipcover 10 has a generally square-shaped central base that serves as the seat portion 27 and is cushioned to provide additional comfort for the occupant over the hard surface of the highchair seat 28. The seat portion 27 has a thin lip of cloth on each side of the crotch section 15 of the front portion to prevent the infant's legs from coming in direct contact with the front edge of the highchair seat 28. The generally T-shaped front portion extends upwardly from the middle of the front side of the seat portion and this configuration allows the infant's legs to pass while shielding the infant from the flexible crotch strap 12 and highchair lap bar 13 once placed on the slipcover 10. As shown in FIG. 1, opposing side portions 19 extend upwardly from each side of the seat portion 27 and serve to cover the side supports (chair arms) 21. The rear portion 22 extends upwardly from the rear side of seat portion 27 to cover the back support 26 of the highchair 11 and has apertures 23 in each opposing corner at the foot of the rear portion 22 to accommodate the use of safety belts integral to the highchair 11.

Referring to FIG. 3, the storage pocket 25 is affixed to the outer surface of the back flap 24 of the rear portion 22. When the slipcover 10 is positioned in the highchair 11, the storage pocket 25 is open at the top of the storage pocket 25, which is centrally located along the lower edge of the back flap 24. The storage pocket 25 is primarily used to store the toy holders (described below),but may store other items as space dictates. The storage pocket 25 is constructed from a rectangular piece of the same material as the rest of the back flap 24. The rectangular piece is positioned along the bottom edge of the back flap 24 of the rear portion 22 and sewn along the bottom and side edges to the back flap 24.

As shown in FIGS. 1–4, when the slipcover 10 is placed in the highchair 11, the upwardly extending side portions 19 are contiguous with the central seat portion 27 and located on opposing sides. The side portions 19 are placed over the side supports (chair arms) 21 of the highchair 11. The side portions 19 prevent the infant from coming in direct contact with the sides supports 21 of the highchair 11, effectively reducing exposure to germs and other unsanitary conditions.

The slipcover 10 of the present invention is a washable, lightweight, flexible, pliable cover designed to cover highchairs, particularly restaurant highchairs used by the general public, thereby preventing the skin of an infant occupying the highchair from coming in direct contact with the highchair and table surface and reducing exposure to germs and unsanitary conditions. In the preferred embodiment, the slipcover 10 is essentially a one-piece, cross-shaped construction made from a washable fabric, such as cotton or a blend thereof, that will facilitate folding, storing, and transporting the invention. The slipcover 10 offers light padding in the seat portion 27 of the slipcover 10 to increase the comfort level of the infant. The padding is made from a durable, quilted material.

Figure 5:
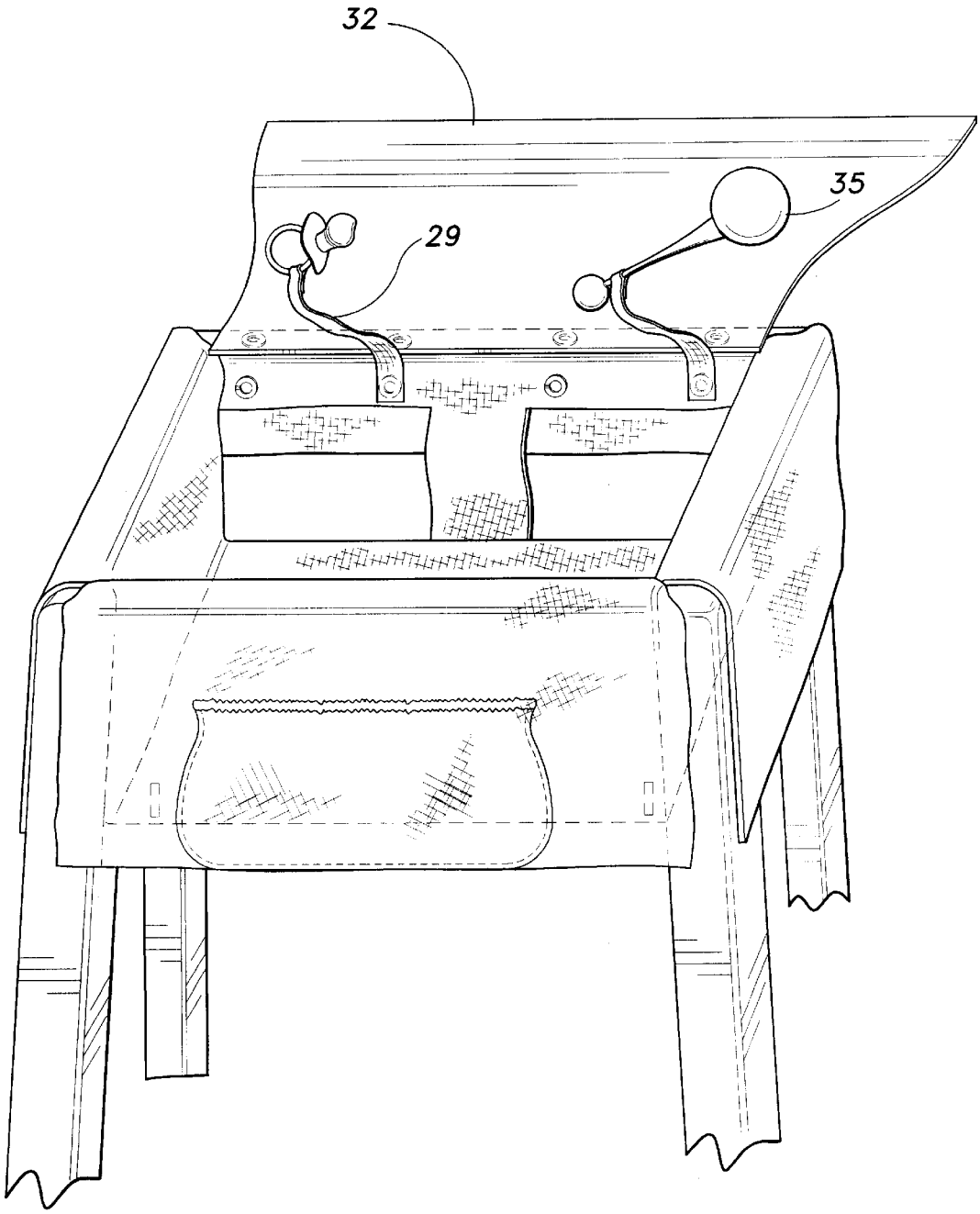
FIG. 5 is a front, environmental, perspective view of washable highchair slipcover according to the present invention with placemat and toy holders attached.
Figure 6:
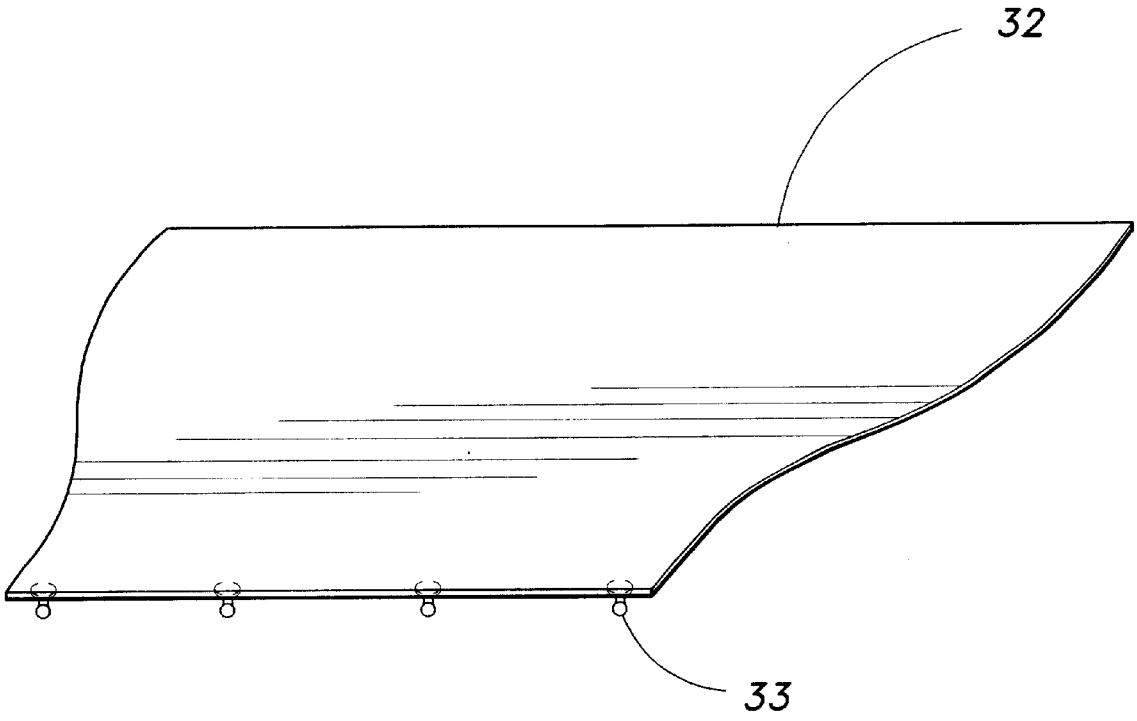
FIG. 6 is a bottom perspective view of a placemat according to the present invention.

Referring to FIGS. 5 and 6, the placemat 32 detachably connects to the front flap 16 of the front portion to prevent an infant in the highchair 11 from touching the table surface. In the preferred embodiment, the placemat 32 is constructed from a thin, flexible, plastic sheet that is surface washable and reusable. The underside of the front edge of the placemat 32 has a plurality of male snap connectors 33 equally spaced that mate with female snap connectors 17 located on the front flap 16 of the front portion.

Figure 7:
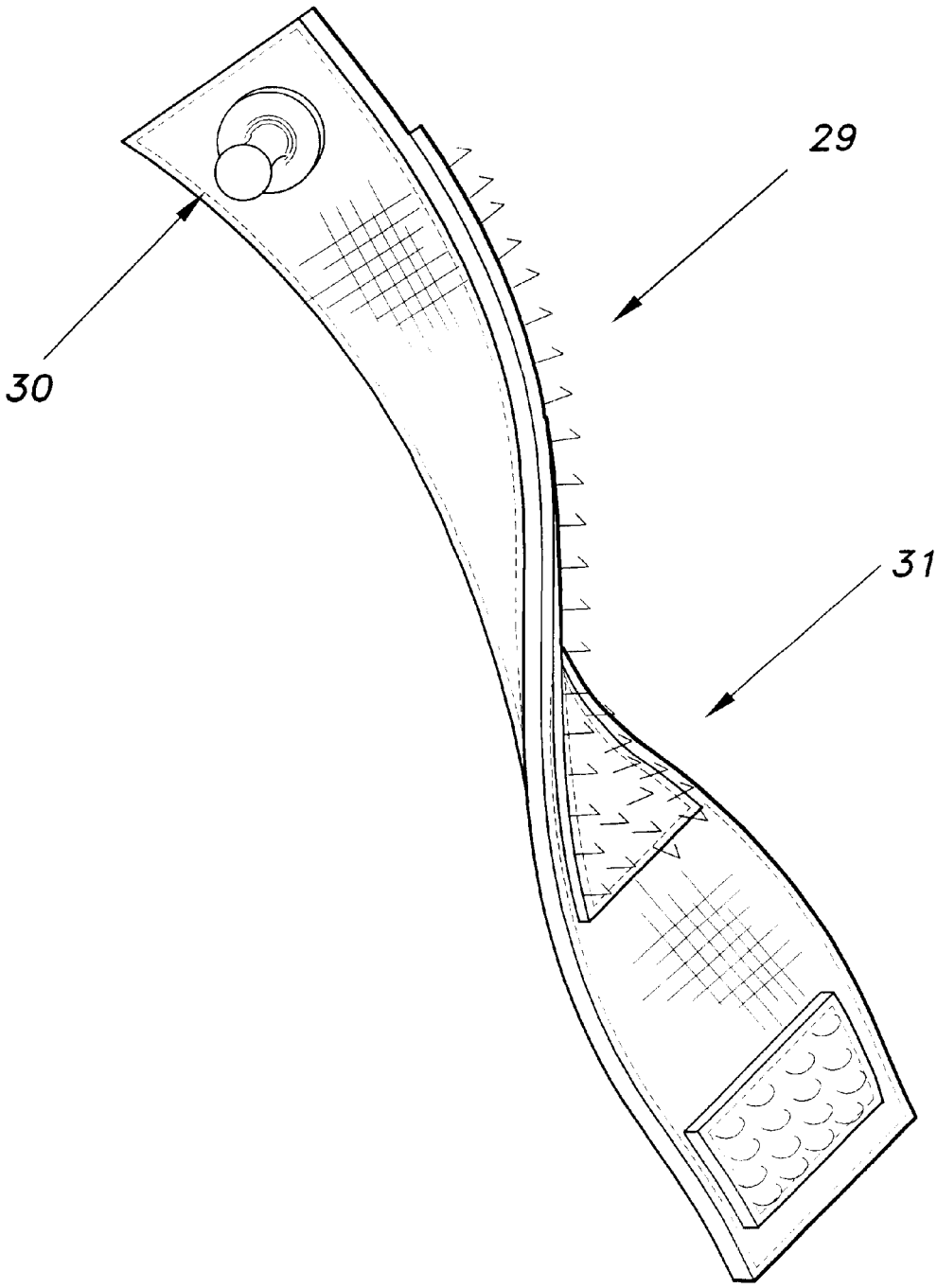
FIG. 7 is a perspective view of a toy holder according to the present invention, twisted to show the front and back surfaces.

Referring to FIGS. 5 and 7, the toy attachment straps 29 detachably connect to the inside upper area of the front portion above the crotch section 15. The straps 29 are made of flexible material, such as nylon, where the underside features a male snap connector 30 at one end that mates with a female snap connector 18 located on the inside upper area of the front portion above the crotch section 15. The upper surface of the strap 29 has mating patches of hook and loop material 31 attached thereto, so that the strap 29 can be wrapped around a toy and fastened into a loop securing the toy to the slipcover 10.

Figure 8:
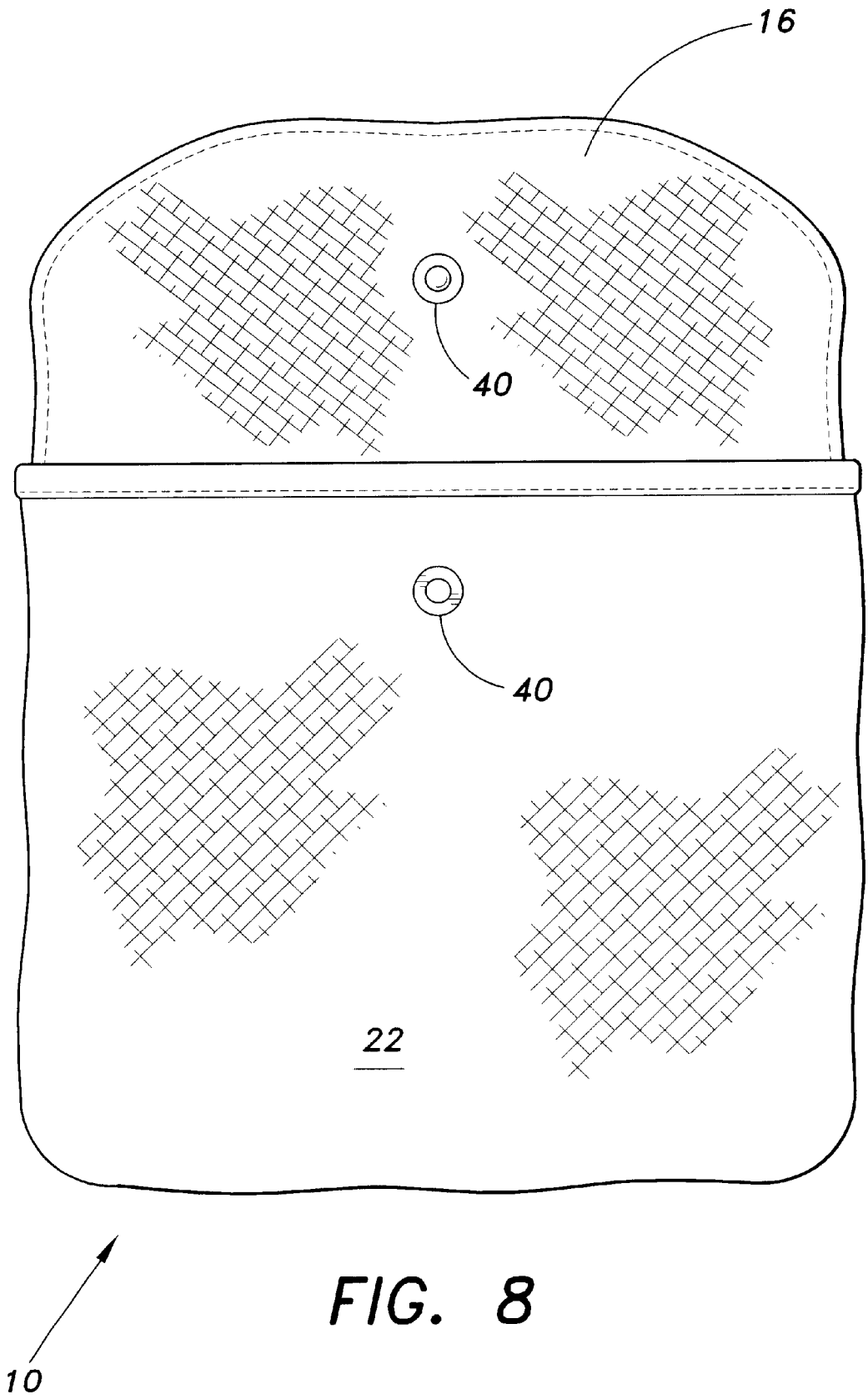
FIG. 8 is a front view of washable highchair slipcover according to the present invention folded for transport.

Referring to FIG. 8, a prospective view of the slipcover 10 as folded for storage or transport. The side portions 19 are folded over the seat portion 27, the rear portion 22 is folded over the side portions 19, and then a snap fastener 40 on the front flap 16 is fastened to a mating snap fastener 40 on the rear portion 22 to secure the slipcover 10 into a compact square package for storage or transport.

It is to be understood that the present invention is not limited to the sole embodiments described above, but encompasses any and all embodiments within the scope of the following claims.

I claim:

1. A washable highchair slipcover for covering a highchair, comprising:

(a) a one-piece cover made from a flexible, washable fabric, the cover having:

(i) a square-shaped central seat panel having a front edge, a rear edge, and two opposing side edges;

(ii) a T-shaped front panel, the T-shape being defined by a narrow crotch section extending from the front edge of said seat panel and a wide front flap extending from the crotch section;

(iii) a rear panel extending from the rear edge of said seat panel;

(iv) a pair of side panels extending from the opposing side edges of said seat panel, respectively, the cover being cruciform in shape when unfolded, and said front panel, said rear panel, and said side panels being individually foldable over said seat panel; and (b) a placemat removably attached to the front flap said front panel;

wherein said seat panel is adapted for covering a seat of the highchair and said rear panel and said side panels are adapted for extending over a seatback and arms of the highchair, respectively.

2. The washable highchair slipcover according to claim 1, further comprising a thin lip of cloth extending from the front edge of said seat panel on opposite sides of said crotch section for covering a front edge of the highchair seat.

3. The washable highchair slipcover according to claim 1, further comprising means for attaching a toy to the front panel.

4. The highchair slipcover in accordance with claim 1, further comprising:

a first snap fastener attached to the front panel;

a strap having a second snap fastener attached thereto mating with said first snap fastener, and having mating patches of hook and loop fastening material attached thereto, whereby the strap is attached to the front panel by mating said snap fasteners and is adapted for being wrapped in a loop around a toy and fastened by said patches of hook and loop fastening material in order to secures the toy to the slipcover.

5. The washable highchair slipcover according to claim 4, further comprising a pocket disposed on said rear panel, whereby said strap is stored in the pocket when not in use.

6. The washable highchair slipcover according to claim 1, wherein:

the front flap further comprises a first set of snap fasteners attached thereto; and said placemat further comprises a second set of snap fasteners attached thereto mating with said first set of snap fasteners for removably attaching said placemat to the slipcover.

7. The washable highchair slipcover according to claim 1, wherein said cover is made from cotton.

8. The washable highchair slipcover according to claim 1, wherein said placemat is made from a reusable, flexible plastic sheet.

9. The washable highchair slipcover according to claim 1, wherein said rear panel has a pair of holes defined therein adapted for accommodating a safety belt integral to the highchair.

10. The washable highchair slipcover according to claim 1, wherein said seat panel is made from a durable, quilted material, whereby said seat panel is cushioned.

11. A washable highchair slipcover for covering a highchair, comprising:

(a) a one-piece cover made from a flexible, washable fabric, the cover having:

(i) a square-shaped central seat panel having a front, edge, a rear edge, and two opposing side edges;

(ii) a T-shaped front panel, the T-shape being defined by a narrow crotch section extending from the front edge of said seat panel and a wide front flap extending from the crotch section;

(iii) a rear panel extending from the rear edge of said seat panel;

(iv) a pair of side panels extending from the opposing side edges of said seat panel, respectively, the cover being cruciform in shape when unfolded, and said front panel, said rear panel, and said side panels being individually foldable over said seat panel;

(b) a first snap fastener attached to the front panel; and (c) a strap having a second snap fastener attached thereto mating with said first snap fastener, and having mating patches of hook and loop fastening material attached thereto, whereby the strap is attached to the front panel by mating said snap fasteners and is adapted for being wrapped in a loop around a toy and fastened by said patches of hook and loop fastening material in order to secure the toy to the slipcover;

wherein said seat panel is adapted for covering a seat of the highchair and said rear panel and said side panels are adapted for extending over a seatback and arms of the highchair, respectively.

12. The washable highchair slipcover according to claim 11, further comprising a pocket disposed on said rear panel, whereby said strap is stored in the pocket when not in use.

13. The washable highchair slipcover according to claim 11, wherein the front flap further comprises a first set of snap fasteners attached thereto, the slip cover further comprising:

a placemat having a second set of snap fasteners attached thereto mating with said first set of snap fasteners for removably attaching said placemat to the slipcover.

14. The washable highchair slipcover according to claim 11, wherein said cover is made from cotton.

15. A washable highchair slipcover for covering al highchair, comprising:

(a) a one-piece cover made from a flexible, washable fabric, the cover having:

(i) a square-shaped central seat panel having a front edge, a rear edge, and two opposing side edges;

(ii) a T-shaped front panel, the T-shape being defined by a narrow crotch section extending from the front edge of said seat panel and a wide front flap extending from the crotch section;

(iii) a rear panel extending from the rear edge of said seat panel;

(iv) a pair of side panels extending from the opposing side edges of said seat panel, respectively, the cover being cruciform in shape when unfolded, and said front panel, said rear panel, and said side panels being individually foldable over said seat panel;

(b) a placemat removably attached to the front flap of said front panel;

(c) a first snap fastener attached to the front panel; and (d) a strap having a second snap fastener attached thereto mating with said first snap fastener, and having mating patches of hook and loop fastening material attached thereto, whereby the strap is attached to the front panel by mating said snap fasteners and is adapted for being wrapped in a loop around a toy and fastened by said patches of hook and loop fastening material in order to secure the toy to the slipcover;

wherein said seat panel is adapted for covering a seat of the highchair and said rear panel and said side panels are adapted for extending over a seatback and arms of the highchair, respectively.

* * * * *